US006513504B2

(12) United States Patent
Ikuma

(10) Patent No.: US 6,513,504 B2
(45) Date of Patent: Feb. 4, 2003

(54) STRUCTURE FOR MOUNTING FUEL PUMP TO ENGINE

(75) Inventor: Tomonori Ikuma, Wako (JP)

(73) Assignee: Honda Giken Kogyo Kabushiki Kaisha (JP)

( * ) Notice: Subject to any disclaimer, the term of this patent is extended or adjusted under 35 U.S.C. 154(b) by 0 days.

(21) Appl. No.: 10/134,942

(22) Filed: Apr. 29, 2002

(65) Prior Publication Data

US 2002/0166543 A1 Nov. 14, 2002

(30) Foreign Application Priority Data

May 10, 2001 (JP) ..... 2001-140360

(51) Int. Cl.[7] ..... F02M 32/04
(52) U.S. Cl. ..... 123/509; 123/508
(58) Field of Search ..... 123/509, 516, 123/510, 508, 507

(56) References Cited

U.S. PATENT DOCUMENTS 4,391,258 A * 7/1983 Claesson ..... 123/508
5,007,401 A * 4/1991 Grohn et al. ..... 123/509
6,082,336 A * 7/2000 Takahashi et al. ..... 123/508
6,244,251 B1 * 6/2001 Wada et al. ..... 123/468
6,296,536 B1 * 10/2001 Katayama et al. ..... 440/77
6,298,815 B1 * 10/2001 Kashima et al. ..... 123/184.21
6,328,020 B1 * 12/2001 Wada et al. ..... 123/509
6,354,278 B1 * 3/2002 Kawasaki ..... 123/509

FOREIGN PATENT DOCUMENTS

JP 45077843 6/1977
JP 10009078 1/1998

* cited by examiner

*Primary Examiner*—Carl S. Miller
(74) *Attorney, Agent, or Firm*—Adams & Wilks

(57) ABSTRACT

A structure for mounting a fuel pump to an engine includes a cylinder head, a valve drive mechanism provided at the cylinder head, and a cylinder head cover covering the cylinder head and the valve drive mechanism. The cylinder head covers are made of synthetic resin. The fuel pump is mounted to the cylinder head with the cylinder head cover held therebetween.

6 Claims, 9 Drawing Sheets

STRUCTURE FOR MOUNTING FUEL PUMP TO ENGINE

FIELD OF THE INVENTION

The present invention relates to a structure for mounting a fuel pump to an engine. More particularly, this invention relates to the structure for mounting the pump to an engine of an outboard motor having a vertically extending crankshaft.

BACKGROUND OF THE INVENTION

Structures for mounting fuel pumps on engines are known from, for example, Japanese Utility Model Post-Exam Publication No. SHO 52-24672 and Japanese Patent Laid-Open Publication No. HEI 10-9078.

A fuel pump disclosed in the publication No. SH 052-24672 is attached directly to a metal cylinder head cover disposed on a cylinder head of an engine. The fuel pump includes a plunger disposed in abutment on a valve rocker arm of the engine. The valve rocker arm is arranged to pivot to thereby drive the plunger. Driving the plunger actuates the fuel pump.

The publication No HEI 10-9078 discloses fuel pumps mounted on an engine of an outboard motor including a vertically extending crankshaft and plural cylinders.

More specifically, the fuel pumps are positioned outside a vertically elongated cylinder head cover of the engine and have horizontally oriented plungers. The plungers are mounted directly to a cylinder head of the engine. The cylinder head cover is made from metal.

The fuel pumps as disclosed in the above publications are attached to the cylinder head covers through bolts or the like. The cylinder head covers are made from metal such as aluminum alloy.

An outboard motor including a large-sized, high-power engine such as a V-6 engine is preferably lightweight for ease attachment to or detachment from a hull of a boat. In other words, the engine which is the heaviest among components of the outboard motor needs to be reduced in weight. A cylinder head cover which covers rocker arms and the like disposed outside the cylinder head of the engine is preferably made from synthetic resin so as to render the engine lightweight.

The cylinder head cover made from synthetic resin is smaller in strength or rigidity than that made from metal. It is thus difficult to mount the fuel pumps, as disclosed in the above publications, to the cylinder head cover of synthetic resin.

One may propose to mount the fuel pumps to any members other than cylinder head cover. For such an application, however, the outboard motor should be provided with additional members for driving the fuel pumps. This leads to the increased number of components provided around the engine. The members for driving the fuel pumps would be complicated in construction.

SUMMARY OF THE INVENTION

An object of the present invention is to provide a structure for advantageously mounting a fuel pump to an engine including a cylinder head cover made from synthetic resin, such that the engine is made lightweight.

Another object of the present invention is to provide an outboard motor including the lightweight engine.

According to one aspect of the present invention, there is provided a structure for mounting a fuel pump to an engine, comprising: a cylinder head of the engine; a valve drive mechanism for driving the fuel pump, the valve drive mechanism being mounted to the cylinder head; a cylinder head cover covering the cylinder head and the valve drive mechanism; and the fuel pump being mounted to the cylinder head with the cylinder head cover held therebetween.

The fuel pump is mounted to the cylinder head of increased rigidity, and hence the cylinder head cover which covers the cylinder head can be made from material smaller in rigidity than the cylinder head cover.

The fuel pump is disposed outside the cylinder head cover. More specifically, the fuel pump is mounted to the cylinder head with the cylinder head cover held therebetween. This allows the cylinder head cover to be held to the cylinder head.

The cylinder head cover can be fastened to the cylinder head without excessive load being applied to the cylinder head cover.

The fuel pump is driven by the valve drive mechanism provided at the cylinder head.

There is no need to mount the fuel pump to any member other than the cylinder head. In other words, driving the fuel pump can be achieved without requiring additional, particular members for driving the fuel pump.

In a preferred form of the present invention, the cylinder head is made of synthetic resin.

In a further preferred form of the present invention, the structure further comprises a support base member attached to the cylinder head, the support base member, the cylinder head cover, and a base sheet of the fuel pump being coupled together by plural bolts, the base sheet being positioned in parallel to the support base member.

With this arrangement, the fuel pump is securely mounted to the cylinder head cover and the support base member.

The fuel pump has the base sheet separable from a body thereof. This arrangement is useful for maintenance of the fuel pump.

In a further preferred form of the present invention, the fuel pump includes a diaphragm to be driven by the valve drive mechanism through a plunger.

The fuel pump thus arranged can efficiently supply fuel towards the engine. The supply of fuel can be effected using the valve drive mechanism.

In a still further preferred form of the present invention, the engine includes vertically extending crankshaft, the cylinder head and the cylinder head cover being vertically oriented, the fuel pump being horizontally oriented, the engine being used in an outboard motor.

Since the cylinder head cover is made of synthetic resin, the engine can be reduced in weight to thereby render the outboard motor lightweight. Such a light weight out board motor is readily attached to or detached from a stern of a boat. Further, the outboard motor of reduced weight is easy to handle. The fuel pump can be disposed outside the cylinder head cover of synthetic resin in the same way the former is disposed outside a metal cylinder head cover. The fuel pump is to be driven by the valve drive mechanism. The outboard motor may include a large-sized engine of large engine capacity to provide an increased output.

In a still further preferred form of the present invention, the cylinder head and the cylinder head cover are disposed at a rear part of the outboard motor, the outboard motor including an intake manifold disposed behind the fuel pump, the intake manifold having a recessed portion formed therein, the recessed portion receiving part of the fuel pump.

Because the recessed portion of the intake manifold receives part of the fuel pump, the outboard motor extends a reduced distance along a front-and-rear direction. In other words, the outboard motor can be made compact.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION OF THE PREFERRED EMBODIMENTS

Figure 1:
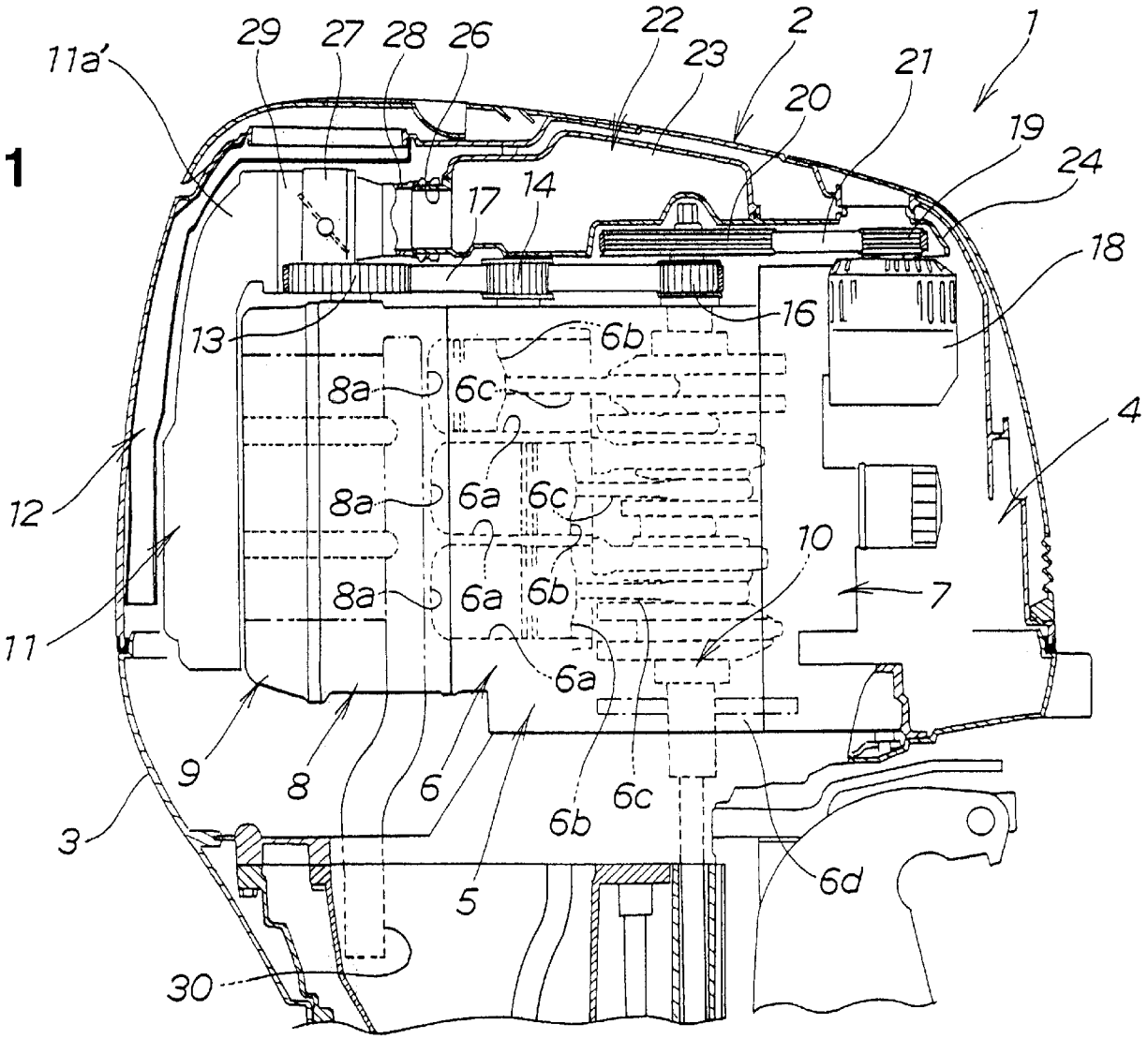
FIG. 1 is a vertical cross-sectional view of an upper part of an outboard motor.

Referring to FIG. 1, an outboard motor 1 is shown including an engine cover 2 positioned at an upper most part thereof, an under cover 3 positioned below the engine cover 2, an extension case (not shown) located below the under cover 3, and a gear case (not shown) and the like disposed under the extension case. The gear case has a screw disposed therein. The engine cover 2 has an engine compartment 4 formed therein.

An engine 5 is disposed within the compartment 4 and includes a cylinder block 6 positioned centrally thereof. The cylinder block 6 has a skirt portion 6*d*. A crank case 7 is disposed forwardly of the skirt portion 6*d*. Cylinder heads 8, 8 (only one shown) are provided behind the cylinder block 6. Cylinder head covers 9, 9 (only one shown) are disposed behind the cylinder heads 8, 8. The cylinder heads 8, 8 and the cylinder head covers 9, 9 are thus positioned at a rear part of the outboard motor 1.

The engine 5 includes a crankshaft 10 extending vertically of the outboard motor 1. In the cylinder block 6, there are formed two sets of three cylinders 6*a* each oriented horizontally. These three cylinders 6a of each set are provided in vertical alignment.

Each cylinder 6*a* has a piston 6*b* disposed therein. The individual pistons 6*b* within the cylinders 6*a* are vertically juxtaposed. The pistons 6*b* are connected via connecting rods 6*c* to the crankshaft 10.

Combustion chambers 8*a* are formed in the cylinder heads 8, 8. The combustion chambers 8*a* correspond in the number to the pistons 6*b*. The cylinder heads 8, 8 and the cylinder head covers 9, 9 will be discussed hereinafter.

Figure 2:
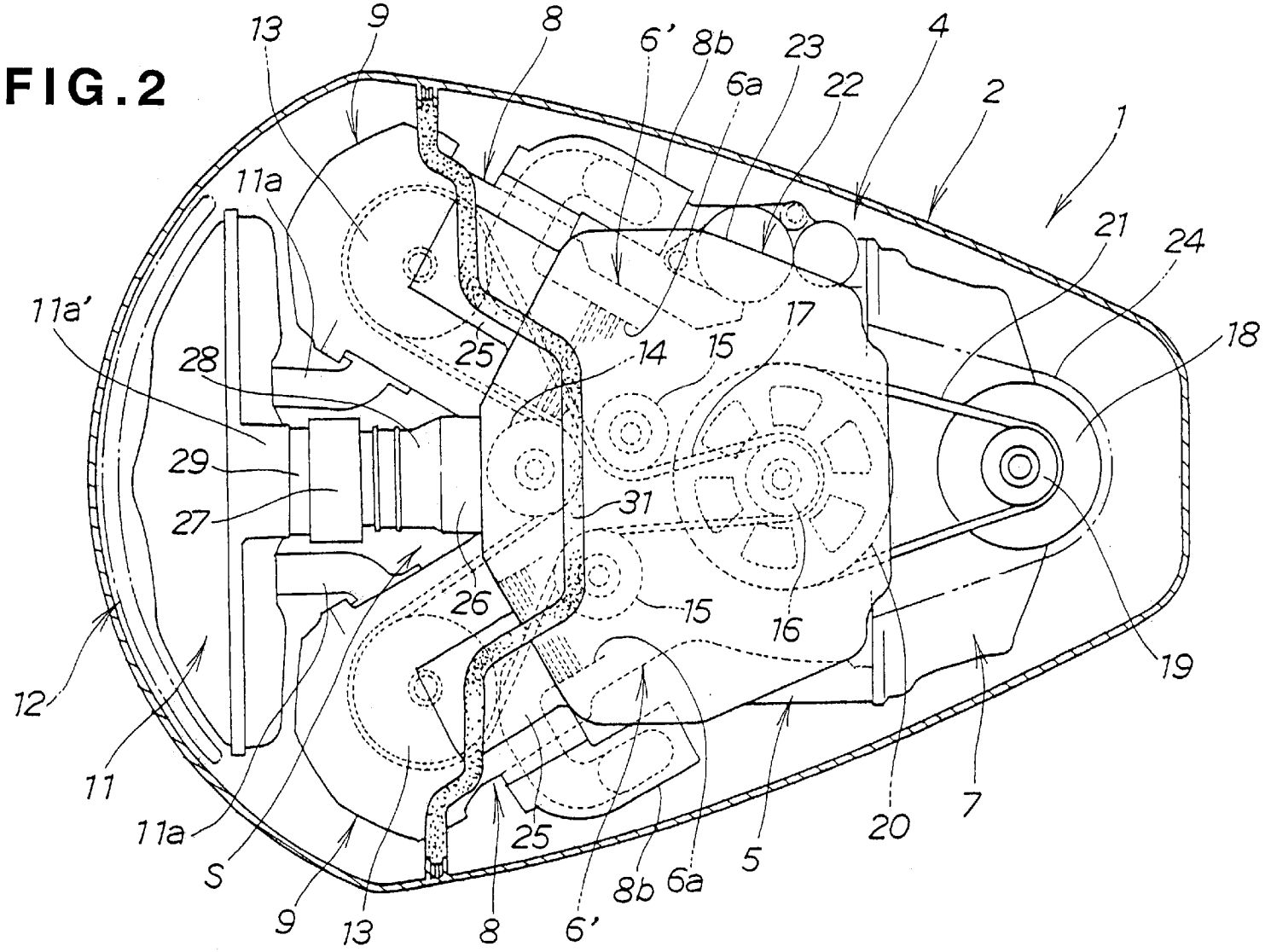
FIG. 2 is a cross-sectional view of the outboard motor to reveal inner components of the outboard motor.

The cylinders 6*a* are disposed in the form of a V to provide a V-6 engine, when viewed from above. As shown in FIG. 2, right and left cylinder block portions 6', 6' of the cylinder block 6 each have the set of the three cylinders 6*a* formed therein.

A space S is formed between the right and left cylinder block portions 6', 6'. An intake manifold 11 is positioned within the space S and extends vertically of the outboard motor 1, as shown in FIG. 1. A guide member 12 for taking in air from outside the outboard motor 1 is provided behind the intake manifold 11.

The intake manifold 11 has a space formed therein. The space of the intake manifold is elongated laterally of the outboard motor 1, as shown in FIG. 2.

The cylinder heads 8, 8 each have an intake port 8*e* (see FIG. 6) formed therein. The respective intake ports are connected to intake pipes 11*a*, 11*a* disposed in the space S.

Camshaft pulleys 13, 13 are positioned above upper surfaces of the cylinder heads 8, 8. A guide pulley 14 and tension pulleys 15, 15 are disposed above an upper surface of the cylinder block 6. A first drive pulley 16 to be driven by the crankshaft 10 is disposed directly above an upper surface of the skirt portion 6*d*.

A timing belt 17 runs over the pulleys 13, 13, 14, 15, 15, 16 and is arranged such that the crankshaft 10 drives acamshaft 35 (see FIG. 3) as will be described later.

A front side of an upper part of the crankcase 7 constitutes a front part of the engine 5, and has an AC generator 18 attached thereto, as shown in FIG. 1. The generator 18 has its drive shaft extending vertically. The generator 18 includes its body having vertically elongated slits formed therein.

A driven pulley 19 for driving the generator 18 is provided above the generator 18. A second drive pulley 20 and the first drive pulley 16 are mounted on an upper end of the crankshaft 10. The pulleys 20, 16 are provided in coaxial relation to each other. A timing belt 21 runs over the pulleys 19, 20. The crankshaft 10, when actuated, drives the generator 18.

A box-shaped intake silencer 22 is disposed over the timing belts and the pulleys as explained above. The intake silencer 22 has its body 23 disposed above the pulley 20. The intake silencer 22 has an extension portion 24 extending forwardly from the body 23. The extension portion 24 is positioned above the pulley 19.

The body 23 has intake ports 25, 25 positioned at right and left sides of a rear part thereof. These ports 25, 25 extend rearwardly and outwardly, and are disposed in symmetric relation to each other.

The body 23 has a connection pipe 26 projecting rearwardly from a center of the rear part thereof. The connection pipe 26 is connected through a grommet 28 to an upstream portion of an intake passageway of a throttle valve device 27 positioned within the space S.

An electric air control valve (EACV) 29 is interposed between the throttle valve device 27 and an upstream connection portion 11*a*' of the intake manifold 11.

A belt cover 39 (see FIG. 4) is positioned below the throttle valve device 27. The belt cover 39 is not shown in FIG. 1 for the purpose of illustrating the throttle valve device 27, the EACV 29 and the like.

The right and left cylinder heads 8, 8 have exhaust manifolds 8*b*, 8*b* extending outwardly therefrom. Exhaust gas is discharged out through the exhaust manifolds 8*b*, 8*b* and an exhaust (see FIG. 1).

A seal member 31 extends across the engine compartment by divide the same into a front part and a rear part. The front part of the compartment 4 includes a source of heat such as the exhaust manifolds 8*b*, 8*b*. The rear part includes an intake system such as the intake manifold 11.

Figure 3:
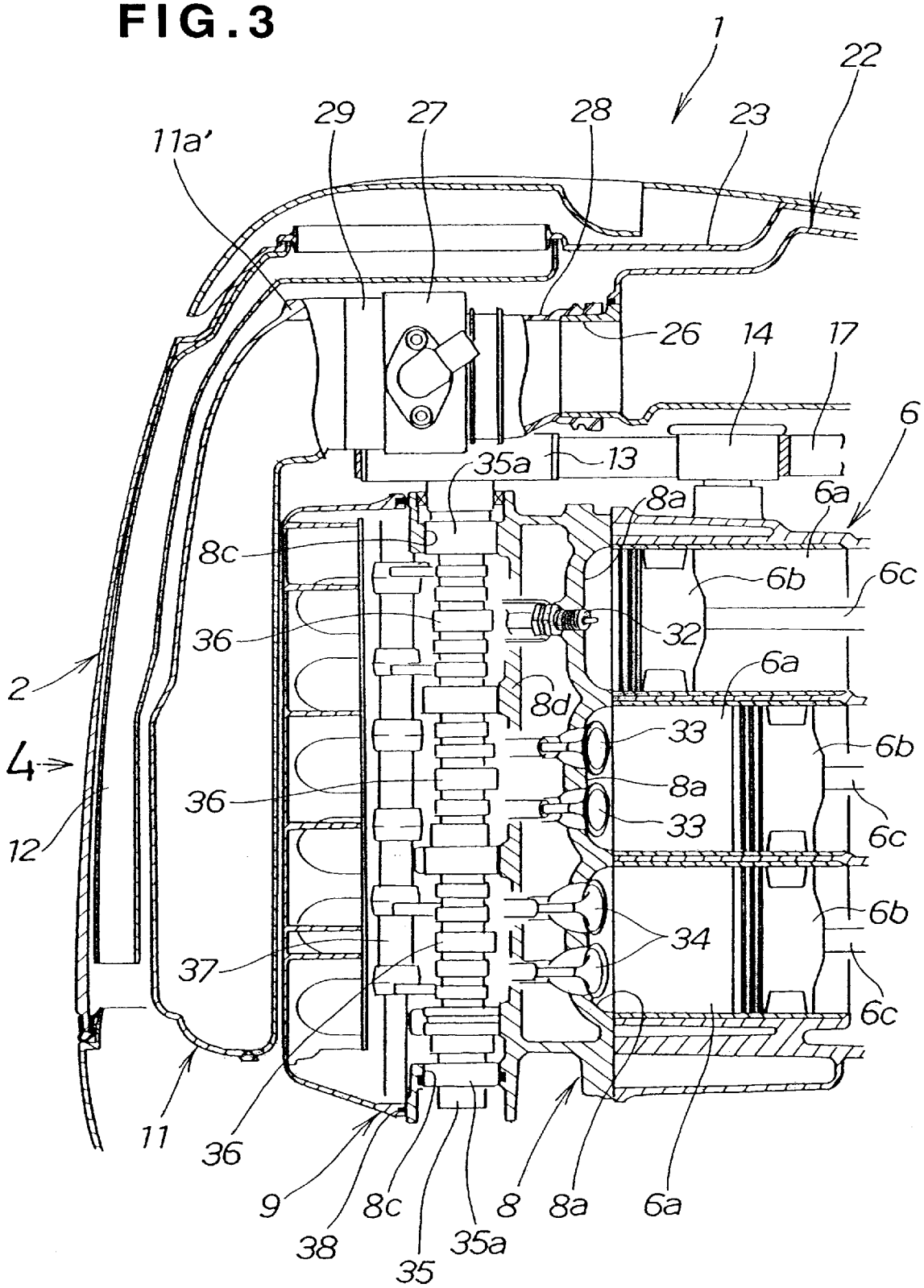
FIG. 3 is a vertical cross-sectional view of a cylinder block, a cylinder head, and a cylinder head cover of an engine of the outboard motor.

Reference is made to FIG. 3. Each of the three combustion chambers 8*a* formed in the cylinder head 8 has a spark plug 32, two intake valves 33, 33 and two exhaust valves 34, 34 provided therein.

The cylinder head 8 includes a separate wall 8*d* behind which the camshaft 35 is positioned in vertical orientation. The camshaft 35 has journal portions 35*a*, 35*a* positioned at upper and lower ends thereof. The journal portions 35*a*, 35*a* are held by bearing portions 8*c*, 8*c*. The camshaft 35 has its upper end protruding from the top of the cylinder head 8. The upper end of the camshaft 35 is fixed to the camshaft pulley 13. Cams 36 are mounted on the camshaft 35 in spaced relation to each other.

Rocker arm shafts 37, 37 which support valve rocker arms 40 (not shown in FIG. 3) for driving the intake and exhaust valves are disposed near the camshaft 35. The rocker arm shafts 37, 37 vertically extend in parallel to the camshaft 35. The rocker arm shafts 37, 37 are spaced from the camshaft 35.

As will be discussed in detail with respect to FIGS. 6 through 8, the valve rocker arms 40, 40 are arranged to control the intake and exhaust valves and pivotally supported by the rocker arm shafts 37, 37.

The camshaft 35, the cams 36, the valve rocker arms 40, 40, and the intake and exhaust valves, as mentioned above, cooperate to provide a valve drive mechanism. The cylinder head cover 9 covers the valve drive mechanism and the cylinder head 8. The cylinder head cover 9 is joined to the cylinder head 8 through a seal material 38.

More specifically, the cylinder head cover 9 is made from synthetic resin. The synthetic resin, from which the cylinder head cover 9 is made, has improved moldability, and the cylinder head cover 9 is lightweight and provides increased rigidity. The cylinder head cover 9 has plural portions firmly attached to the cylinder head 8.

Figure 4:
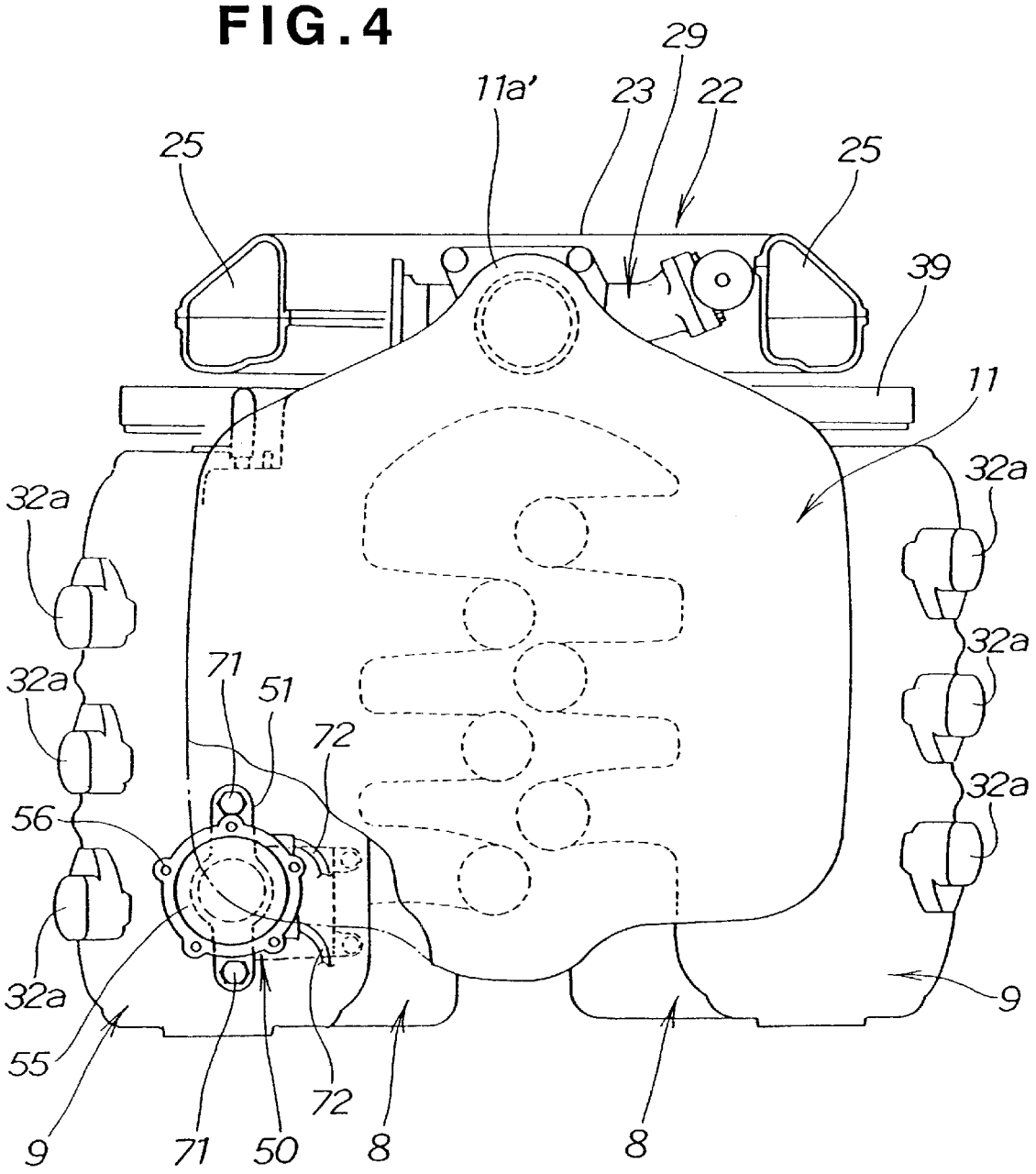
FIG. 4 shows the engine having a portion cut away to reveal a fuel pump, as viewed in a direction designated by a reference numeral 4.

As shown in FIG. 4, the right and left cylinder head covers 9, 9 are shown as being spaced from each other. So are the right and left cylinder heads 8, 8. The cylinder head covers 9, 9 are vertically oriented. Likewise, the cylinder heads 8, 8 are vertically oriented.

The vertically elongated cylinder head covers 9, 9 each have three spark plug covers 32*a* disposed in vertical alignment.

The intake silencer 22 has the intake ports 25, 25 directed rearwardly. The EACV 29 is disposed behind the intake silencer 22.

The left cylinder head cover 9 has a fuel pump 50 disposed rearwardly thereof.

Figure 6:
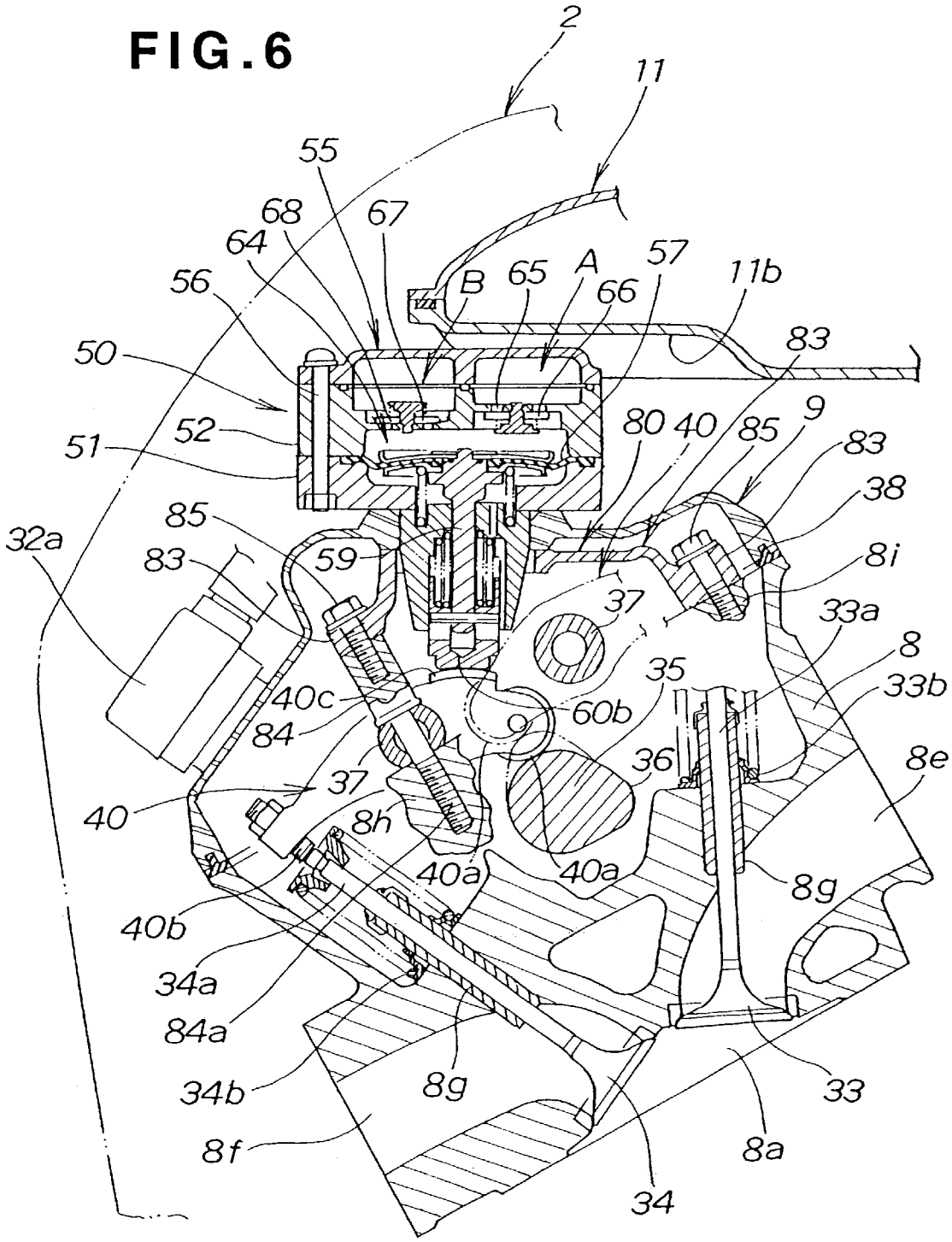
FIG. 6 is a cross-sectional view taken along line 6-6 of FIG. 5.

With respect to FIG. 6, the cylinder head 8 has the intake port 8*e* and an exhaust port 8*f* formed therein to communicate with the combustion chamber 8*a* through the valves 33, 34. The intake and exhaust valves 33, 34 are disposed within the ports 8*e*, 8*f*, respectively. Guide sleeves 8*g*, 8*g* extend to the intake and exhaust ports 8*e*, 8*f*, respectively. More specifically, the guide sleeves 8*g*, 8*g* have their respective lower ends located within the ports 8*e*, 8*f*. The guide sleeves 8*g*, 8*g* retain valve stems 33*a*, 34*a* therein. The valve stems 33*a*, 34*a* extend through valve springs 33*b*, 34*b*, respectively. The intake and exhaust valves 33, 34 are urged by these springs 33*b*, 34*b* in such a direction as to be closed.

The valve rocker arms 40, 40 are pivotally supported by the rocker arm shafts 37, 37 positioned near the camshaft 35.

In the illustrated embodiment, the two intake valves and the two exhaust valves are provided for each cylinder 6*a*, and the number of the valve rocker arms 40 is the same as that of all the intake and exhaust valves.

The valve rocker arm 40 has one end 40*a* which abuts on the cam 36. Rotation of the cam 36 causes the valve rocker arm 40 to pivot on the rocker arms haft 37. The arm 40 has another end 40*b* pushing the valve stem against the valve spring. This arrangement controls the intake and exhaust valves 33, 34.

As discussed in relation to FIG. 4, the cylinder head cover 9 has the fuel pump 50 disposed outside a lower part of a rear surface thereof.

The fuel pump 50 is horizontally oriented. The fuel pump 50 projects rearwardly from the rear surface of the cylinder head cover 9 into a recessed portion 11*b* of the intake manifold 11 extending laterally of the outboard motor 1. The recessed portion 11*b* is opened at one side thereof, such that a rear part of the fuel pump 50 has its half portion received or positioned in the recessed portion 11*b*.

Figure 9:
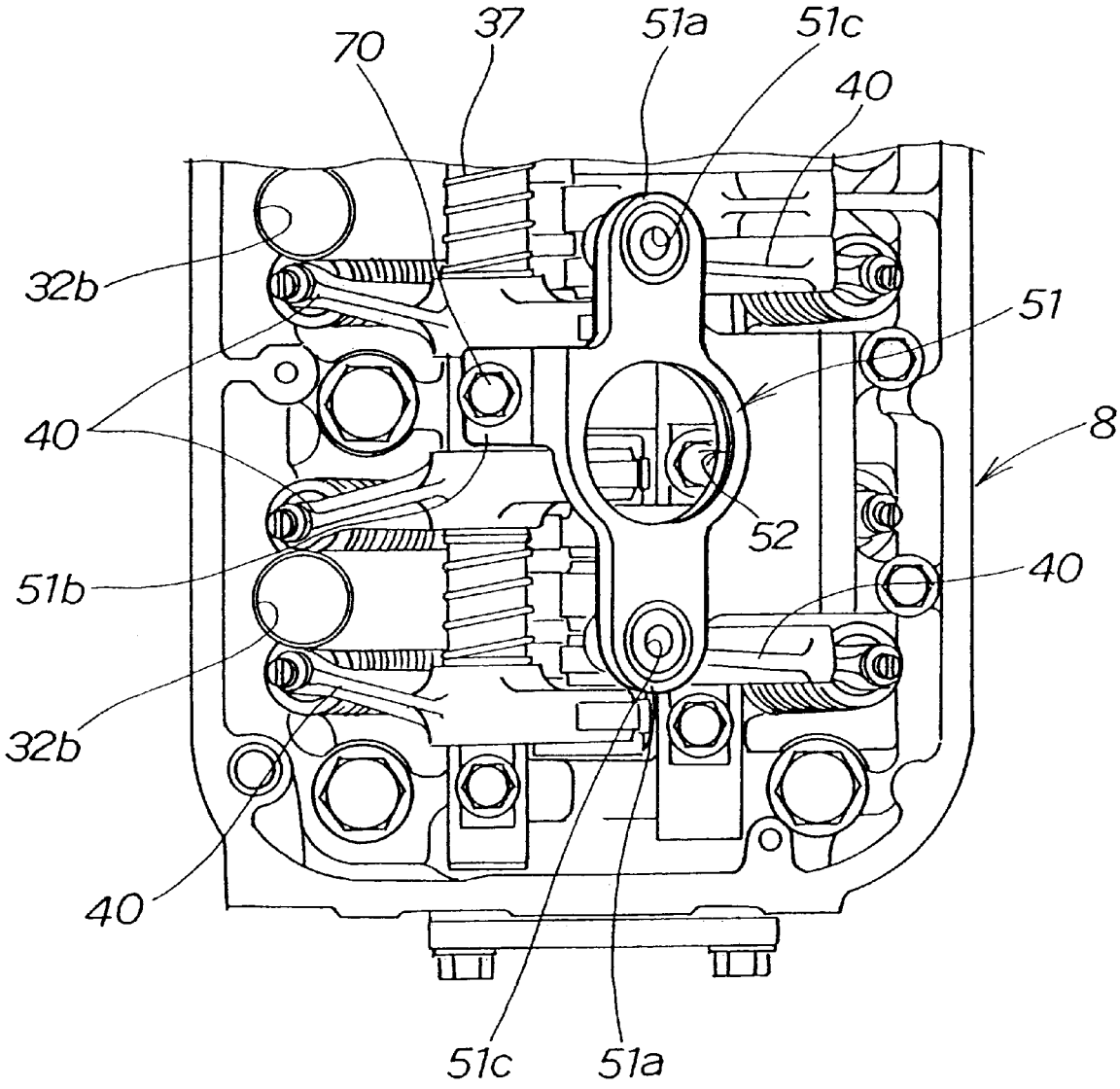
FIG. 9 shows the cylinder head with the cylinder head cover removed.

Turning to FIG. 9, the fuel pump 50 includes a base sheet 51. The base sheet 51 is elongated in an up-and-down direction of the outboard motor 1 and is disposed behind a lower portion of a rear side of the cylinder head 8. The base sheet 51 has upper and lower ends 51*a*, 51*a* bolted to a side of the cylinder head 8, as will be described later in detail. The base sheet 51 has a leg portion 51*b* formed integrally with an intermediate portion thereof. The leg portion 51*b* projects sideways. The leg portion 51*b* is coupled through a bolt 70 to the side of the cylinder head 8. Apertures 32*b* are to receive the spark plugs 32. Formed in the intermediate portion of the base sheet 51 is an aperture 52 of circular contour.

Figure 7:
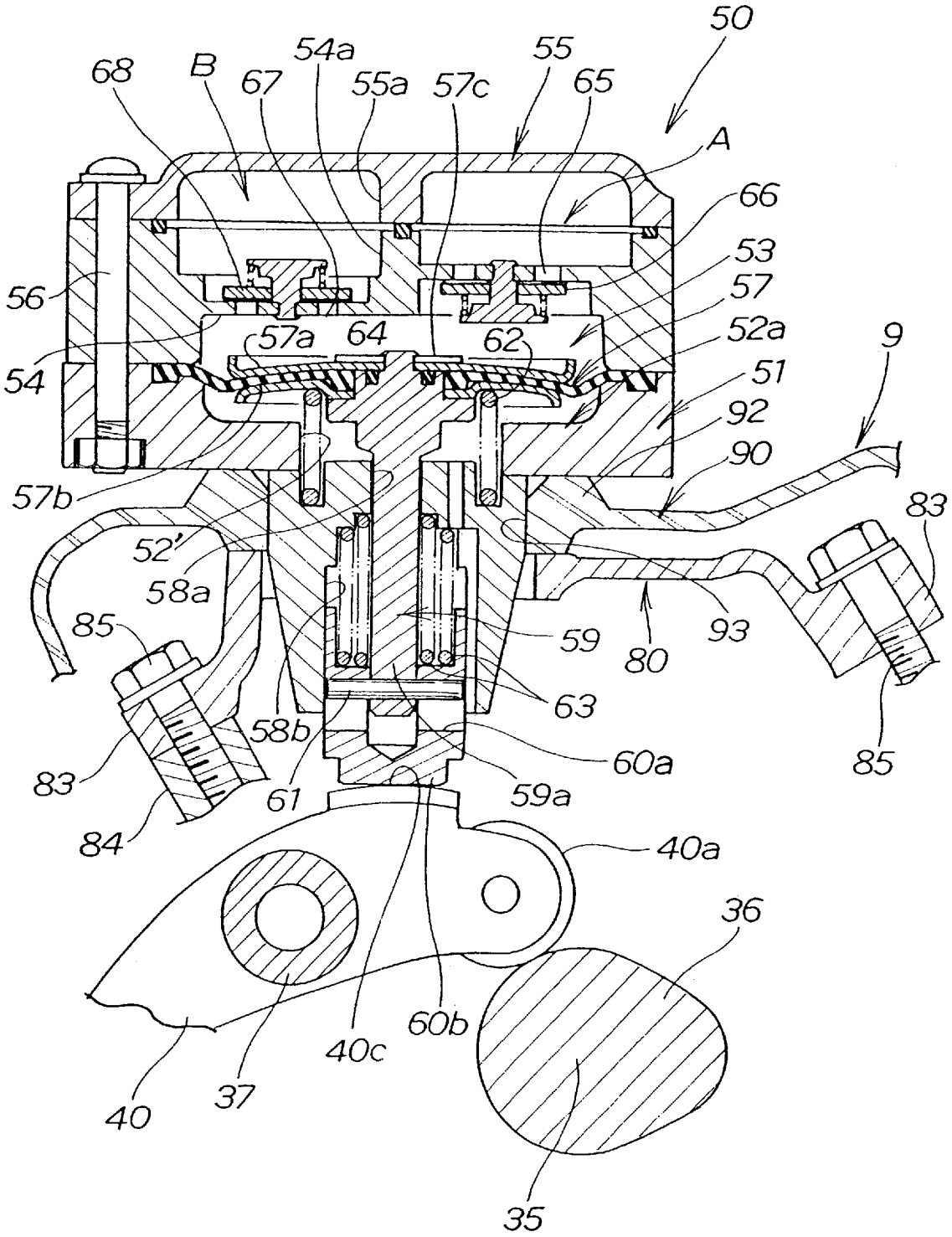
FIG. 7 is an enlarged cross-sectional view of the fuel pump.
Figure 8:
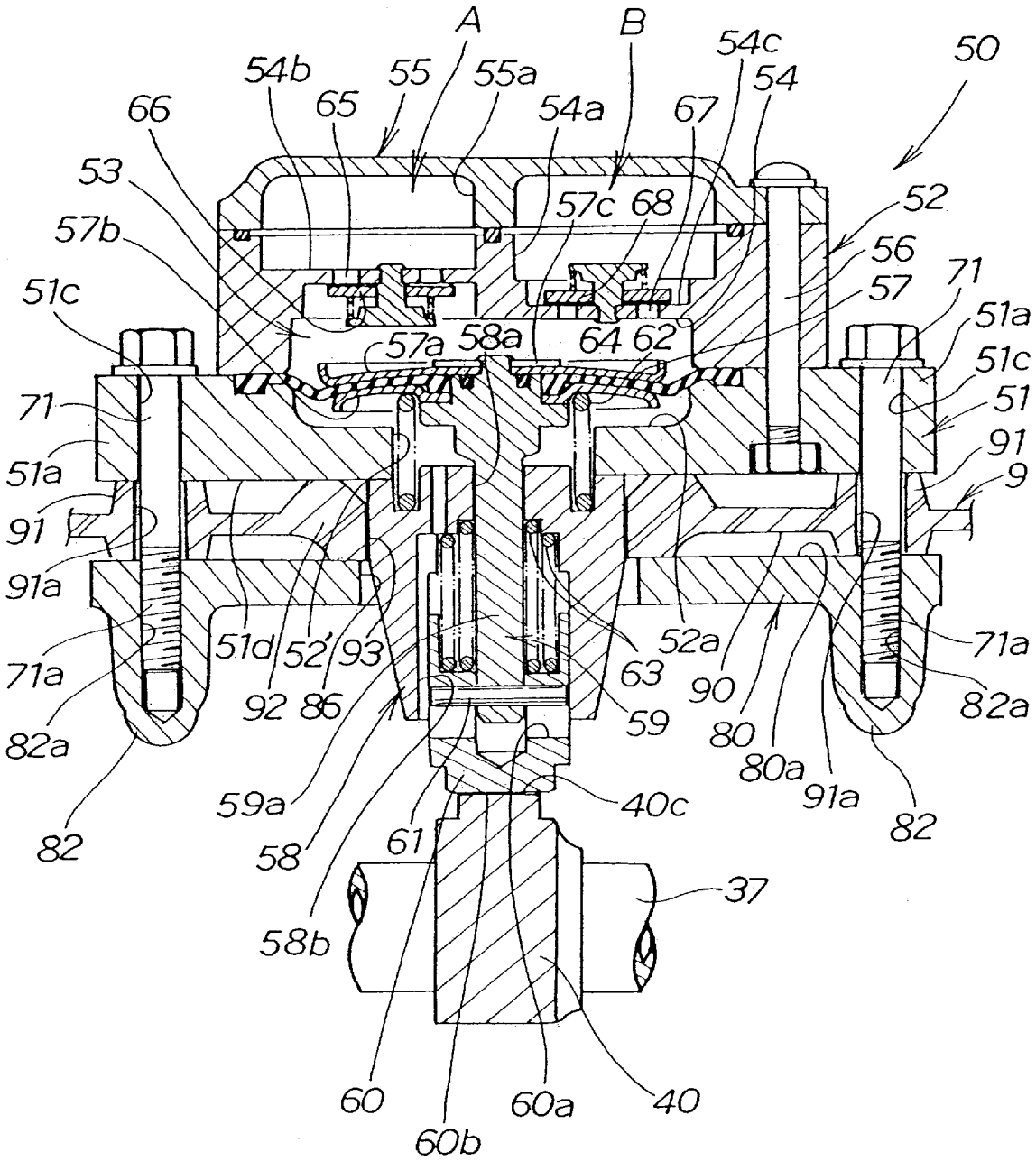
FIG. 8 is a cross-sectional view taken along line 8-8 of FIG. 5.

Referring to FIG. 7 and FIG. 8, a support base member 80 has its opposite ends 83, 83 fixed via bolts 85, 85 to an upper half bearing 84 and a portion 8*i* (see FIG. 6) of the cylinder head 8. The support base member 80 is positioned in parallel to the base sheet 51. The upper half bearing 84 has a bolt 84*a* (see FIG. 6). The cylinder head 8 has a lower half bearing 8*h* (see FIG. 6). The upper half bearing 84 is secured to the lower half bearing 8*h* with the rocker arm shaft 37 held therebetween. This allows the support base member 80 to be attached to the cylinder head 8. The support base member 80 and the cylinder head 8 can thus be joined together.

As shown in FIG. 8 and FIG. 9, the ends 51*a*, 51*a* have mounting apertures 51*c*, 51*c* formed therein. Bolts 71, 71 are inserted through the apertures 51*c*, 51*c*.

The bolt 71 has a threaded end 71*a*. The support base member 80 fixed to the cylinder head 8 includes boss portions 82, 82 having screw holes 82*a*, 82*a* formed therein. The threaded ends 71*a*, 71*a* threadedly engage the holes 82*a*, 82*a*. With this arrangement, the support base member 80 is firmly mounted to the cylinder head 8.

The support base member 80 has its exterior surface 80*a* covered with the cylinder head cover 9.

The cylinder head cover 9 includes a portion 90 having boss portions 91, 91 spaced from each other. The boss portions 91, 91 have insertion apertures 91*a*, 91*a* formed therein. In covering the cylinder head 8 with the cylinder head cover 9, the bolts 71, 71 are inserted through the apertures 51*c*, 51*c*, 91*a*, 91*a* into the holes 82*a*, 82*a* with the portion 90 positioned or held between a back side 51*d* of the base sheet 51 and the exterior surface 80*a* of the support base member 80. This allows the base sheet 51, the cylinder head cover 9, and the support base member 80 to be coupled together through the bolts 71, 71.

The base sheet 51 of the fuel pump 50 is disposed outside the cylinder head cover 9.

With this arrangement, the base sheet 51 is attached through the bolts 71, 71, 70 to the side of the cylinder head 8.

Discussion will be made as to the fuel pump with reference to FIG. 6 through FIG. 8.

The fuel pump 50 includes a body 52. The body 52 has a recessed portion 53 formed on a side thereof proximal to the base sheet 51. The base sheet 51 has a recessed portion 52*a* formed on a side thereof facing the recessed portion 53. The recessed portion 52*a* has an aperture 52' formed centrally thereof. The aperture 52' is of relatively large diameter.

The portion 90 of the cylinder head cover 9 has a large diameter boss portion 92 provided between the boss portions 91, 91. The large diameter boss portion 92 has a large diameter aperture 93 formed therein. The aperture 93 is aligned with the aperture 52'.

The body 52 has a separation wall 54 serving as a ceiling of the recessed portion 53. The body 52 has a partition portion 54*a* integral with the separation wall 54. A lid 55 is disposed on an exterior surface of the body 52. The lid 55 includes a partition portion 55*a* joined to the partition portion 54*a*. The lid 55 and the body 52 have their edges through which bolts 56 extend. The bolts 56 further extend through the base sheet 51 to thereby couple the lid 55 and the body 52 to the base sheet 51.

The recessed portion 53 and the recessed portion 52*a* jointly define a space across which a diaphragm 57 extends. The diaphragm 57 has its edge held between the body 52 and the base sheet 51.

The support base member 80 has an aperture 86 formed therein. The aperture 86 is in alignment with the aperture 93. A holder 58 is partly fitted through the aperture 86 into the aperture 93. The holder 58 has an aperture 58*a* formed therein. The holder 58 also has an elongated recess portion 58*b* formed therein. The aperture 58*a* communicates with the recess portion 58*b*.

The diaphragm 57 includes first and second holder plates 57*a*, 57*b* and a clip 57*c*. A plunger 59 has one end held to central parts of the plates 57*a*, 57*b* and the clip 57*c*. The plunger 59 extends through the aperture 58*a* into the recess portion 58*b*.

The plunger 59 has a small diameter portion 59*a* formed at middle and lower parts thereof. The small diameter portion 59*a* extends within the recess portion 58*b*. The recess portion 58*b* has a pusher 60 fitted thereinto. The small diameter portion 59*a* has a pin 61 extending across a lower part thereof. The pusher 60 has a long aperture 60*a* formed therein. The pin 61 is positioned within the aperture 60*a*.

Between the holder 58 and the second holder 57*b*, there extends a coil spring 62 held in a compressed position. More specifically, the coil spring 62 extends through the aperture 52'. The holder 58 has an annular groove formed therein. The annular groove is sized to receive one end of the coil spring 62.

The recess portion 58*b* has two compressed coil springs 63, 63 disposed therein. More specifically, each of the coil springs 63, 63 has one end held to the pusher 60.

The pusher 60 has its one end surface 60*b* held in contact with a slide surface 40*c* of the valve rocker arm 40.

The recessed portion 53 serves as a pump chamber 64. The separation wall 54 is formed by half portions 54*b*, 54*c*. The half portion 54*b* has plural intake apertures 65 formed therein. These intake apertures 65 are opened and closed by a valve 66 positioned at the half portion 54*b*. Likewise, the half portion 54*c* has plural discharge apertures 67 formed therein. The apertures 67 are opened and closed by a valve 68 disposed at the half portion 54*c*. An intake chamber A is separated from a discharge chamber B by the partition portions 54*a*, 55*a*. The chamber A communicates with the intake apertures 65 while the chamber B communicates with the discharge apertures 67.

Figure 5:
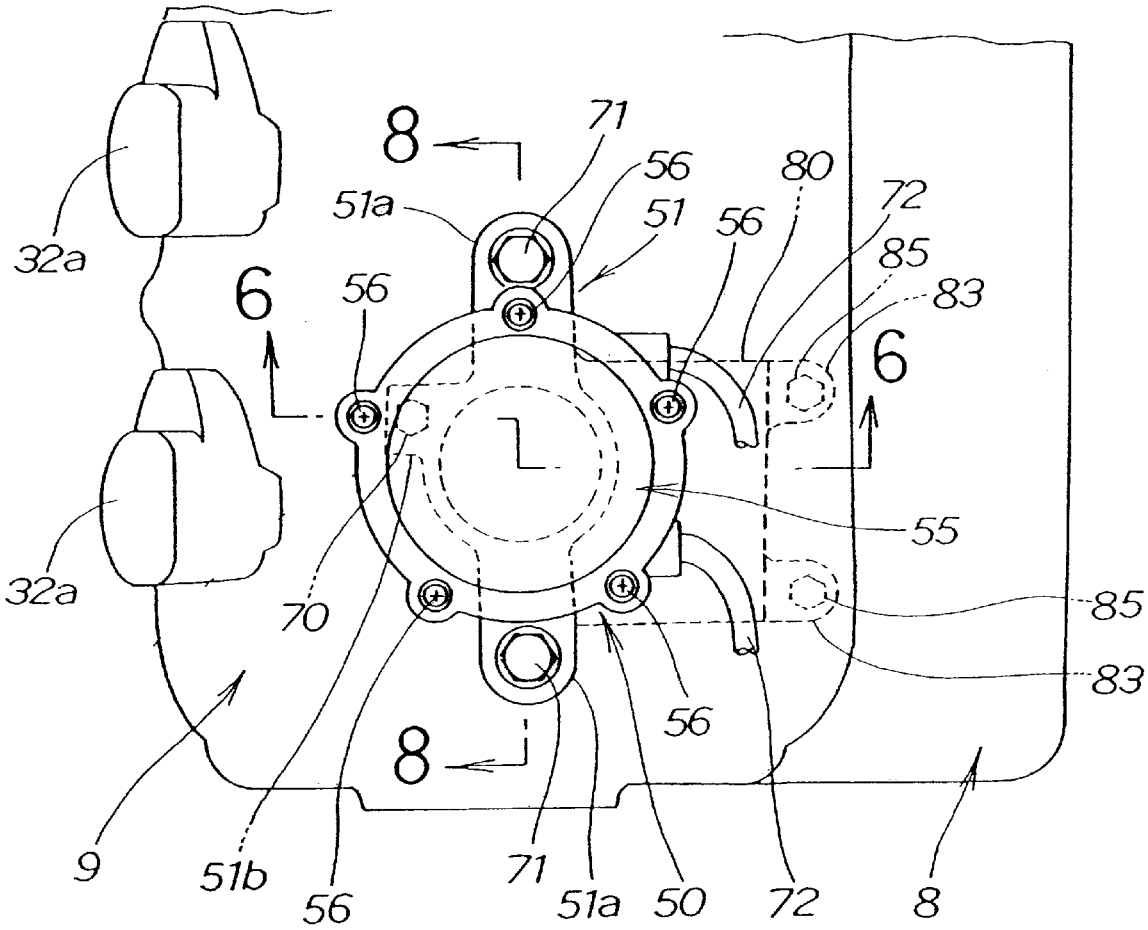
FIG. 5 shows, on an enlarged scale, the fuel pump.

The fuel pump 50 is connected via the chamber A to pipes and the like. The chamber B is connected via pipes etc. to a fuel supply passageway. The pipes connected to the chambers A, B include a fuel introduction pipe and a pressurized fuel discharge pipe 72, 72 as shown in FIG. 4 and FIG. 5.

The fuel pump 50 having the diaphragm 57 is operated in a well known manner as follows.

When driven by the camshaft 35, the cam 36 is caused to rotate. The rotation of the cam 36 causes the valve rocker arm 40 to pivot on the rocker arm shaft 37. This pivotal movement of the arm 40 causes the pusher 60 to move the plunger 59 up and down. This causes the diaphragm 57 to move reciprocally within the chamber 64. With this arrangement, the valve 66 is opened to allow fuel to be taken into the chamber 64 through the chamber A and the apertures 65. The fuel within the chamber 64 is pressurized in such a manner as to be discharged through the apertures 67 into the chamber B when the valve 68 is opened. The fuel discharged into the chamber B is then supplied via the discharge pipe 72 to the fuel supply passageway.

As discussed above, the fuel pump 50 is disposed outside the cylinder head cover 9 made of synthetic resin. The fuel pump 50 as described above is secured to the side of the cylinder head 8.

In the illustrated embodiment, the present invention is applied to the V-6 engine of the outboard motor having the vertically extending crankshaft. However, the engine may be an in-line engine. The engine also may have the crankshaft disposed in horizontal orientation and the cylinder head cover of synthetic resin.

The present disclosure relates to the subject matter of Japanese Patent Application No. 2001-140360, filed May 10, the disclosure of which is expressly incorporated herein by reference in its entirety.

What is claimed is:

1. A structure for mounting a fuel pump to an engine, comprising:

a cylinder head of said engine;

a valve drive mechanism for driving said fuel pump, said valve drive mechanism being mounted to said cylinder head;

a cylinder head cover covering said cylinder head and said valve drive mechanism; and said fuel pump being mounted to said cylinder head with said cylinder head cover held therebetween.

2. A structure for mounting a fuel pump to an engine as claimed in claim 1, wherein said cylinder head cover is made from synthetic resin.

3. A structure for mounting a fuel pump to an engine as claimed in claim 1, further comprising a support base member attached to said cylinder head, said support base member, said cylinder head cover, and a base sheet of said fuel pump being coupled together by plural bolts, said base sheet being positioned in parallel to said support base member.

4. A structure for mounting a fuel pump to an engine as claimed in claim 1, wherein said fuel pump includes a diaphragm to be driven by said valve drive mechanism through a plunger.

5. A structure for mounting a fuel pump to an engine as claimed in claim 1, wherein said engine includes a vertically extending crankshaft, said cylinder head and said cylinder head cover being vertically oriented, said fuel pump being horizontally oriented, said engine being used in an outboard motor.

6. A structure for mounting a fuel pump to an engine as claimed in claim 5, wherein said cylinder head and said cylinder head cover are disposed at a rear part of said outboard motors, said outboard motor including an intake manifold disposed behind said fuel pump, said intake manifold having a recessed portion formed therein, said recessed portion receiving part of said fuel pump.

* * * * *